United States Patent [19]

Fraioli

[11] Patent Number: 4,889,103

[45] Date of Patent: Dec. 26, 1989

[54] INFRARED WOK HEATER

[76] Inventor: Joseph Fraioli, 8 Seymour Pl., White Plains, N.Y. 10605

[21] Appl. No.: 345,406

[22] Filed: May 1, 1989

Related U.S. Application Data

[63] Continuation-in-part of Ser. No. 147,862, Jan. 25, 1988, Pat. No. 4,825,846.

[51] Int. Cl.[4] ..... F24C 3/02

[52] U.S. Cl. ..... 126/92 AC; 431/347; 126/92 R

[58] Field of Search ..... 126/92 R, 92 AC, 39 R, 126/39 A, 39 F, 39 J; 431/326, 347, 348; 239/555; 432/222

[56] References Cited

U.S. PATENT DOCUMENTS

| | | | |
|---|---|---|---|
| 2,594,914 | 4/1952 | Grosskloss | 126/92 R |
| 2,621,722 | 12/1952 | Abrams | 239/555 |
| 2,870,829 | 1/1959 | Williams | 126/92 AC |
| 3,136,354 | 6/1964 | Fitzgerald | 431/348 |
| 3,933,146 | 1/1976 | Hastings | 126/38 |
| 4,432,727 | 2/1984 | Fraioli | 126/92 AC |
| 4,507,083 | 3/1985 | Fraioli | 126/92 AC |
| 4,702,693 | 10/1987 | Fraioli | 431/348 |

FOREIGN PATENT DOCUMENTS

| | | | |
|---|---|---|---|
| 171924 | 12/1921 | United Kingdom | 126/92 AC |

*Primary Examiner*—Margaret A. Focarino

*Attorney, Agent, or Firm*—Michael Ebert

[57] ABSTRACT

An infrared heater for a bowl-shaped cooking wok having a central region and an annular region surrounding the central region. The heater includes a ribbon-type gas-fired burner head fed with a pressurized mixture of air and gas that is expelled from the head through a cylindrical array of minute jet openings to produce, when ignited, an omnidirectional flame. Also provided is a round block of refractory material which when heated to an elevated temperature by the head emits infrared radiation. The block has superposed base, intermediate and top sections, the base section having a cavity therein whose central zone communicates with central openings in the intermediate and top sections, and an outer zone which communicates with a circular array of bores in the intermediate and top sections. The burner head is placed within the block so that the flame projected from the lower portion of the cylindrical array impinges on the wall of the cavity in the base section, whereby the resultant radiation is emitted through the bores to provide secondary beams, while the flame projected from the lower portion of the array impinges on the wall of the opening in the intermediate section, whereby the resultant radiation is emitted through the openings to provide a main beam. The wok is seated above the block so that its central region is heated by the main beam and its annular region is heated by the outer beams.

12 Claims, 4 Drawing Sheets

GAS
AIR
DUAL-VALVE CONTROLLER
10
11
12
13
14
15
16
17
18
19
20
21
22
Cu
Cl

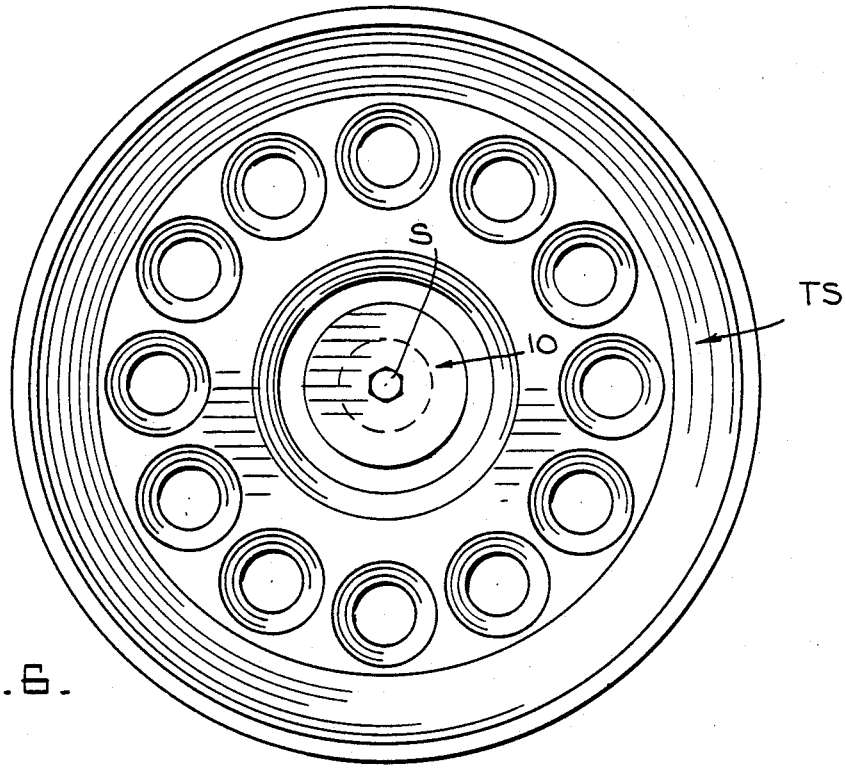
Fig. 6.
Fig. 7.
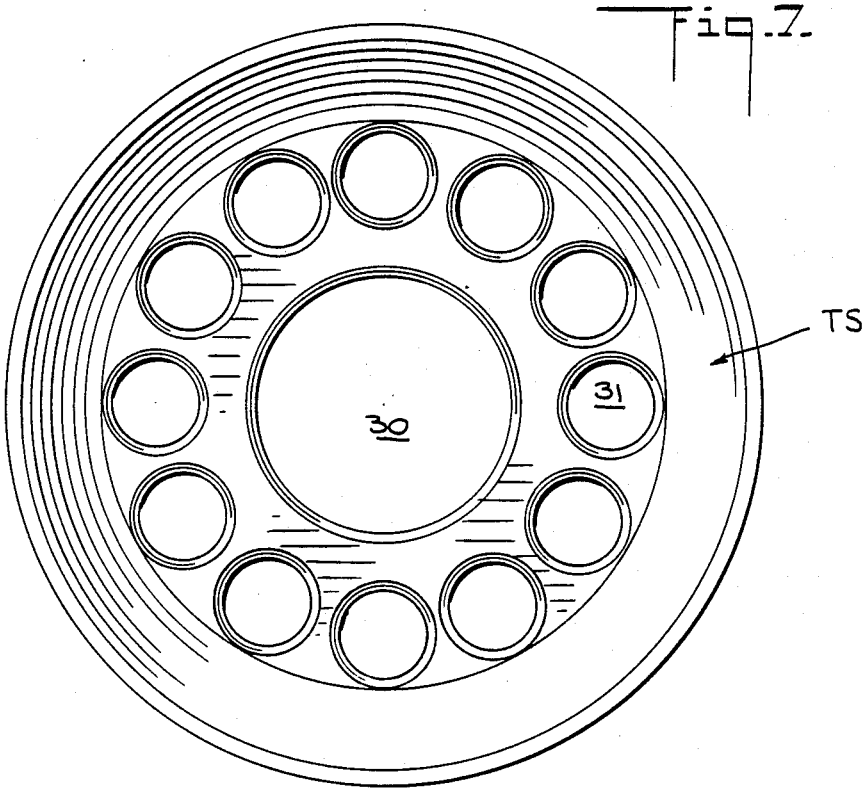

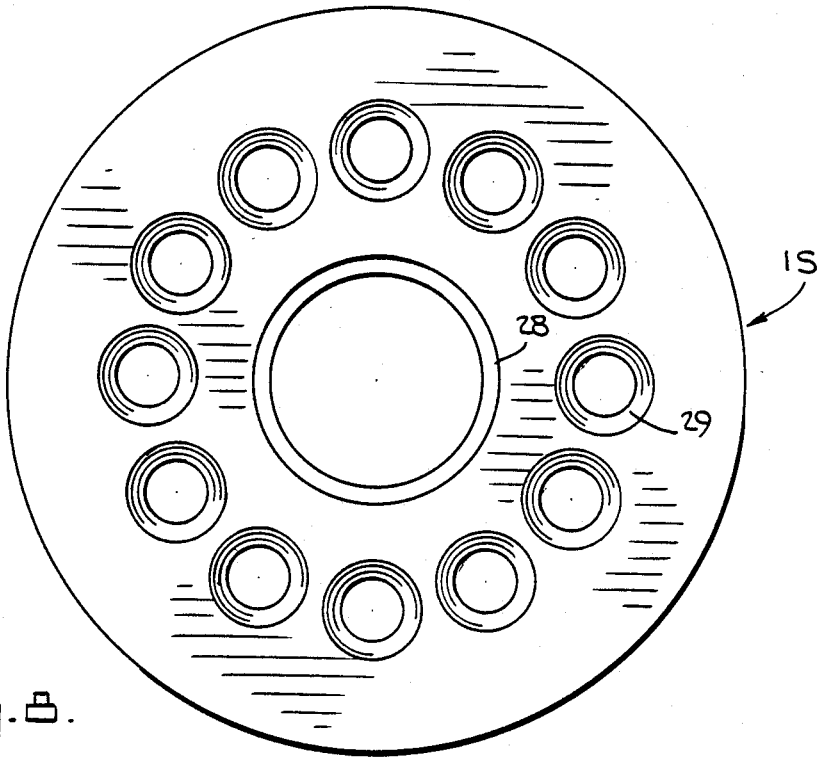
Fig. 8.
Fig. 9.
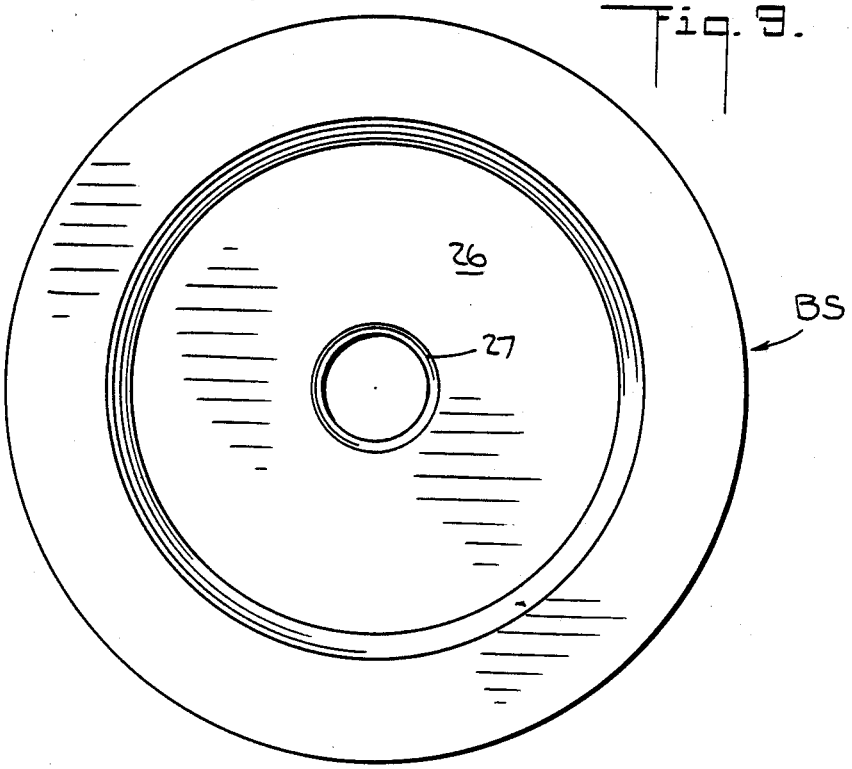

INFRARED WOK HEATER

RELATED APPLICATION:

This application is a continuation-in-part of copending application Ser. No. 147,862, filed Jan. 25, 1988, entitled "Ribbon-Type, Gas-Fired Burner Head," now U.S. Pat. No. 4,825,846 whose entire disclosure is incorporated herein by reference.

BACKGROUND OF INVENTION

1. Field of Invention

This invention relates generally to infrared heaters in which a refractory body is heated by means of a ribbon-type, gas-fired burner head to an elevated temperature causing it to emit infrared radiation, and more particularly to an infrared heater of this type adapted to supply heat energy to a cooking wok.

2. Status of Prior Art

The transfer of heat takes place by three processes: conduction, convection and radiation. In conduction, heat is transferred through a body by the short range interaction of molecules and/or electrons. Convention involves the transfer of heat by the combined mechanisms of fluid mixing and conduction. In radiation, electromagnetic energy is emitted toward a body and the energy incident thereto is absorbed by the body to raise its temperature. Radiant heating, therefore, differs from both convection and conduction heating, for the presence of matter is not required for the transmission of radiant energy.

According to the Stefan-Boltzmann law, the rate of heat transfer between a source of radiated heat whose temperature is $T_s$ and an absorbing body whose temperature is $T_b$ is equal to $T_s^4 - T_b^4$; that is, to the difference between the fourth powers of these temperature values. In convection heating, the rate of heat transfer is proportional only to the temperature difference between the body being heated and the surrounding atmosphere. Hence convection heating is inherently very slow, as compared to the nearly instantaneous effects of radiant heating.

My prior patents 4,507,083; 4,432,727 and 4,702,693 disclose infrared heaters in which a refractory body is heated by means of a ribbon-type burner to an elevated temperature causing it to emit infrared radiation. The ribbon-type burner is of the type disclosed, for example, in the Flynn U.S. Pat. No. 3,437,322, in which a gas-air fuel mixture is fed into a cylinder having a longitudinal slot therein occupied by a stack of corrugated ribbons to create an array of minute jet openings through which the gas-air mixture is expelled. Because of the myriad of jet openings, the projected flame is not composed of discrete jets but assumes a sheet-like form.

However, the intensity of the flame is not uniform throughout the length of the ribbon, for the pressure of the gas-air mixture in the cylinder is not equalized throughout its length. Hence, the resultant infrared radiation pattern is not of uniform intensity; and when food is subjected to this pattern, the heating thereof may be uneven.

In my above-identified copending patent application, there is disclosed a ribbon-type, gas-fired burner head usable as a heat source, which head may also be combined with a refractory body to form an infrared radiation heater. The burner head includes a pair of parallel plates having a circular, oblong or other configuration having a continuous contour free of discontinuities, and a stack of continuous corrugated ribbons having the same configuration sandwiched between the peripheral margins of the plates to define an internal fuel chamber.

Fed into this chamber through an inlet nipple attached to one of the plates is a mixture of pressurized combustion air and gaseous fuel in a stoichiometric ratio, the mixture being expelled from the chamber through an array of minute jet openings created by the stack of ribbons. By igniting the expelled mixture, there is projected from the head an omni-directional flame whose intensity is substantially uniform in all direction. The flame is directed at a refractory body to heat it to an elevated temperature, causing it to emit infrared radiation.

The present invention deals with an infrared heater of a type disclosed in my copending application which is adapted to supply heat energy to a wok. A wok is a bowl-shaped metal cooking utensil used mainly in the preparation of Chinese food, such as chopped up vegetables.

In wok cooking, a load of chopped up food ingredients is deposited in the central region of the bowl, cooking oil being added thereto. In the course of cooking, which takes place in a few minutes, the food is agitated by the cook so that it is spread into the annular region of the wok surrounding the central region.

The range or stove conventionally used for wok cooking is provided with ring-type gas burners whose flame is projected from the periphery of the ring. The wok is seated over the ring so that its center is aligned with the center of the ring. As a consequence, the heat supplied by the ring impinges on the wok in an outer region surrounding its central region. Hence the central region of the wok where most of the food load is deposited does not receive as much heat as the surrounding region, a condition which is less than ideal. Moreover, the stove counter on which the wok is placed has heat transferred thereto from the outer region of the wok, and this heat is radiated into the room in which the stove is installed, thereby raising it to an uncomfortable temperature.

It is for this reason that some ranges are provided with water-cooled coils to reduce the counter temperature. Stoves of this type therefore require both gas and water lines. A further drawback of such prior arrangements is that the BTU requirements for gas-fired burners are considerably higher than for infrared heaters supplying an equivalent amount of heat; hence they are more expensive to operate.

SUMMARY OF INVENTION

In view of the foregoing, the main object of this invention is to provide an infrared heater for a bowl-shaped cooking wok which supplies heat energy thereto that is greatest in the central region of the wok, thereby making it possible to cook a load of food efficiently and in a relatively brief period.

A significant advantage of the invention is that because the annular region of the wok which surrounds its central region receives less heat than the central region, relatively little heat is transferred to the counter of the stove, and no need exists, therefore to cool this counter. Also an advantage of the invention is that the infrared heater supplies heat at a much faster rate than a convection heater and requires substantially less BTUs of energy to operate than a gas-fired burner for the same purpose.

More particularly, an object of this invention is to provide an infrared heater of the above type in which a gas-fired, ribbon-type burner is combined with a refractory body which when heated to an elevated temperature by the burner emits infrared radiation for heating the food deposited in the wok.

Still another object of the invention is to provide an infrared heater of the above type which may be readily assembled and manufactured at low cost.

Briefly stated, these objects are attained in an infrared heater for a bowl-shaped cooking wok having a central region and an annular region surrounding the central region. The heater includes a ribbon-type gas-fired burner head fed with a pressurized mixture of air and gas that is expelled from the head through a cylindrical array of minute jet openings to produce, when ignited, an omnidirectional flame. Also provided is a round block of refractory material which when heated to an elevated temperature by the burner head emits infrared radiation. The block has superposed base, intermediate and top sections, the base section having a cavity therein whose central zone communicates with central openings in the intermediate and top sections, and an outer zone which communicates with a circular array of bores in the intermediate and top sections.

The burner head is placed within the block so that the flame projected from the lower portion of the cylindrical array impinges on the wall of the cavity in the base section, whereby the resultant radiation is emitted through the bores to provide secondary beams, while the flame projected from the lower portion of the cylindrical array impinges on the wall of the opening in the intermediate section, whereby the resultant radiation is emitted through the openings to provide a main beam. The wok is seated above the block so that its central region is heated by the main beam and its annular region is heated by the outer beams.

BRIEF DESCRIPTION OF DRAWINGS

For a better understanding of the invention as well as other objects and further features thereof, reference is made to the following detailed description to be read in conjunction with the accompanying drawings, wherein:

FIG. 6 is a top view of the wok heater with the wok removed;

FIG. 7 is a top view of the top section of the refractory block included in the heater;

FIG. 8 is a top view of the intermediate section of the block; and

FIG. 9 is a top view of the base section of the block.

DETAILED DESCRIPTION OF INVENTION

Figures 1, 2, 3:
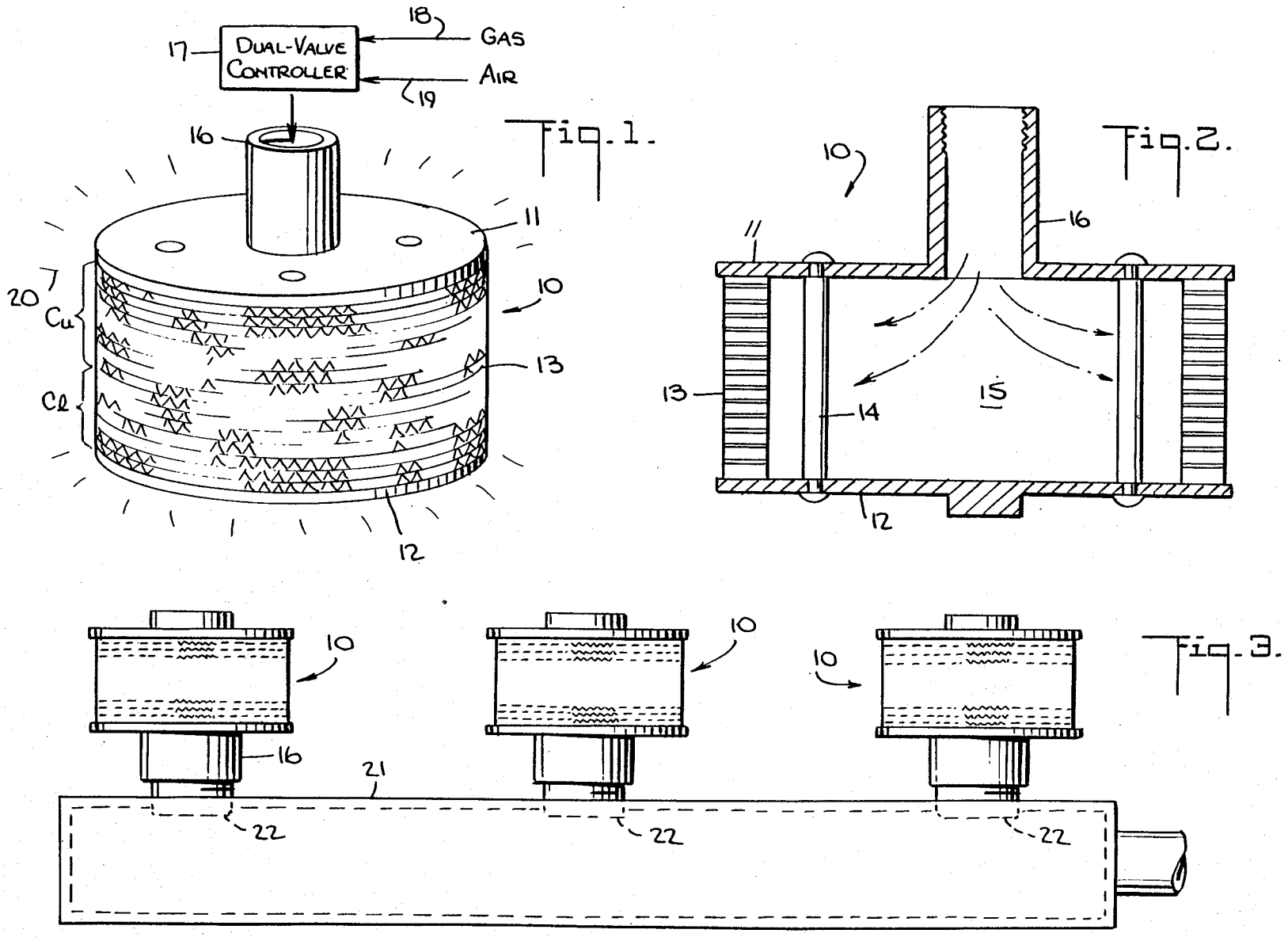
FIG. 1 is a perspective view of a ribbon-type, gas-fired burner head included in an infrared heater for a wok in accordance with the invention.
FIG. 2 is a diametrical section taken through the burner head.
FIG. 3 illustrates, in an elevational view, a multi-head heater, each head of which is of the type shown in FIG. 1.

Gas-Fired Burner Head:

Referring now to FIGS. 1 and 2, there is illustrated a ribbon-type, gas-fired burner head, generally designated by numeral 10, which head is combined with a refractory block, to be later described, to form an infrared radiation heater for a wok in accordance with the invention. Head 10 includes a pair of round metal disks 11 and 12 in parallel relation. In practice, the disks may be fabricated of cast iron, stainless steel or other corrosion-resistant material of high strength.

A stack 13 of continuous, corrugated, ring-shaped ribbons having the same contour as the disks is sandwiched between the peripheral margins of the disks which are held together by rivets 14. The parallel disks which are peripherally enclosed by ribbon stack 13 define a fuel chamber 15.

Welded or otherwise attached to the central zone of disk 11 and communicating with fuel chamber 15 is a nipple 16 of the same metal which serves as an inlet to the fuel chamber. Nipple 16 is coupled by suitable piping to the output of an air-gas controller 17 which preferably is of the dual-valve type disclosed in my prior U.S. Pat. No. 4,640,678. Controller 17 is supplied both with pressurized gas through an input line 18 and with pressurized combustion air through a line 19 coming from the output of an air blower or other suitable source.

Controller 17 is adapted to mix the incoming air and gas to produce a combustible fuel air-gas mixture and to vary the flow rate thereof without, however, altering a predetermined air/gas ratio. This ratio is preferably a stoichiometric ratio resulting in complete combustion. Thus in the case of methane gas, this ratio is 64 grams of oxygen to 16 grams of methane. However, since every chemical reaction has its characteristic proportions, the ratio for optimum efficiency will depend on the gaseous fuel that is used. Because the stoichiometric ratio is maintained regardless of the flow rate setting of the controller, it becomes possible to operate the burner head at optimum efficiency throughout a broad range extending from a minimum, very low heat intensity, to a maximum, very high heat intensity.

The pressurized fuel fed by controller 17 into fuel chamber 15 is discharged from this chamber through the cylindrical array of minute jet openings created by the tack 13 of corrugated ribbon rings. By igniting the expelled fuel, there is projected from the head a flame 20. Because the array of jet openings has a cylindrical geometry, flame 20 is omnidirectional. And because the gas pressure within fuel chamber 15 is substantially uniform throughout the chamber and the impedance offered to the discharge of the fuel by the ring of corrugated ribbons in stack 13 is substantially uniform in all directions, the intensity of the projected flame is substantially uniform in all directions.

Because the gaseous fuel is expelled from the cylindrical array of jet openings of the burner in all directions without any interruption, it becomes possible to ignite the fuel with a single spark gap igniter placed in the proximity of the burner head. In prior ribbon-type, gas-fired burners in which gaseous fuel is expelled from opposite sides of a burner or in other prior arrangements in which interruptions exist between two or more sheets of flame projected from the burner, it is necessary to provide a separate igniter for each flame.

And since the burner head in accordance with the invention produces an omnidirectional flame of substantially uniform intensity in all directions, for automatic control purposes, all that is required is a single thermal sensor in the proximity of the burner head to produce a signal whose magnitude depends on the flame intensity. This signal is compared in an electronic controller with an adjustable set point to maintain the flame intensity at a desired setting in a given range. Thus a burner head having a continuous geometry simplifies the ignition and the other controls associated with a gas-fired burner head.

Where as in a stove it is necessary to provide multiple sources of heat, a bank of gas-fired burners 10 may be provided, as shown in FIG. 3. In this multiple burner arrangement, use is made of a fuel manifold 21 provided with a row of equi-spaced, externally-threaded outlet pipes 22 for coupling to the internally-threaded nipples 16 of burner head 10. Thus in this instance, all three burners are concurrently controllable in the manner shown in FIG. 1.

It is to be noted that burner 10 in FIG. 1 is longer than the pancake-shaped round burner shown in my copending application, so that in this instance, there is a cylindrical array of minute jet openings. This cylindrical array has a lower portion $C_l$ and an upper portion $C_u$ whose significance will become evident in connection with the refractory block with which the burner is associated, as will be later explained.

Figure 4:
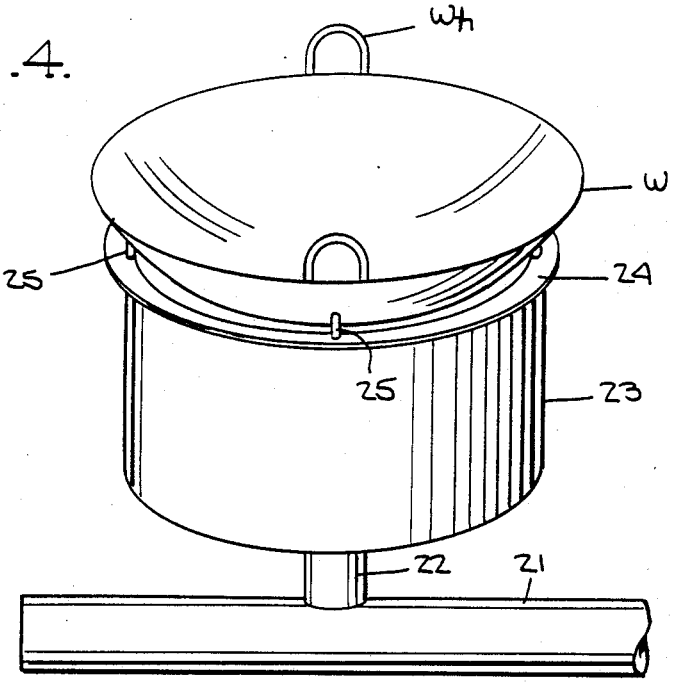
FIG. 4 is a perspective view of the wok heater.
Figure 5:
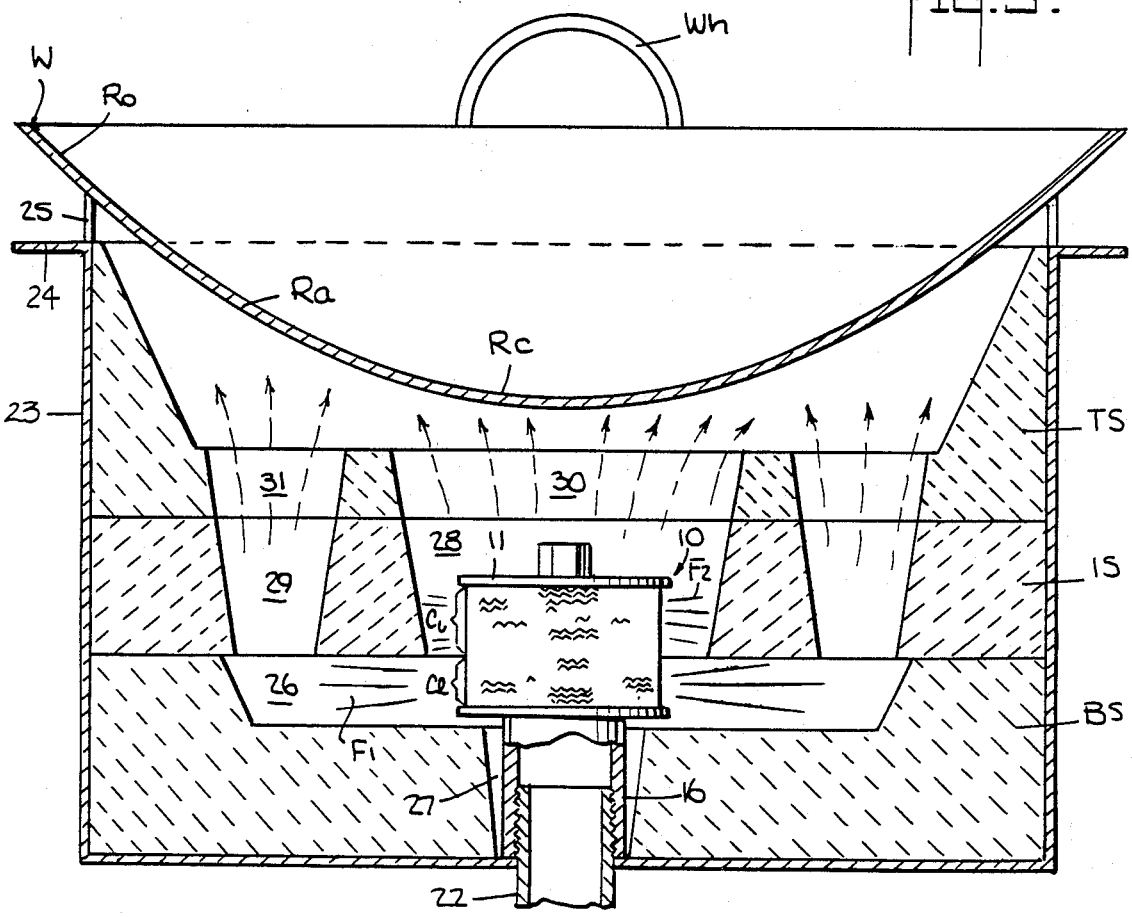
FIG. 5 is a section taken through the wok heater.

The IR Wok Heater:

Referring now to FIGS. 4 and 5, an infrared radiation wok heater in accordance with the invention includes a cylindrical metal open casing 23 whose rim is provided with a circular flange 24. Secured to the rim of casing 23 and projecting thereabove are equi-shaped studs 25 on which a bowl-shaped metal wok W is seated. The studs serve to provide an air space between the wok and the heater to permit the escape of expanding hot air. The diameter of the wok is somewhat greater than that of the casing 23 so that the outer region $R_o$ of the wok is outside of the housing. Wok W is provided with handles $W_h$, so that it can be removed from the heater.

Received within casing 23 is a circular block of refractory material formed by three superposed sections; namely, a base section BS, an intermediate section IS, and a top section TS.

Each section of the block is composed of refractory material, a preferred material for this purpose being "Cera Form," a refractory produced by Johns-Manville, of Denver, Colo., made from a wet slurry formulation that includes refractory fibers and multi-component binder systems. Thus "Cera Form" type 103 includes Alumina (39.6%) and Silica (50.7%). Because the material can be molded, it can be made into the special shapes called for in the present application. In practice, however, the refractory body may be molded in integral form rather than being made up of individual sections. While a fibrous refractory body has been disclosed, the infrared emitting material may be of ceramic or any other suitable composition.

Base section BS, as shown in FIGS. 5 and 9, is provided with a cavity 26 having a frusto-conical form, and a center bore 27 leading into the cavity. The gas-fired burner head 10 is placed within the refractory body with its nipple 16 received within bore 27, the nipple threadably engaging an outlet pipe 22 of the manifold feeding a pressurized air-gas mixture into the internal chamber of the burner head.

To facilitate the installation of the burner head, the top disk 11 thereof is provided with a hexagonal torque stud S. This is engageable by the hexagonal socket of a tool, thereby making it possible to turn the burner to threadably engage the manifold outlet pipe or to decouple the head therefrom.

The intermediate section IS, as shown in FIGS. 5 and 8, of the refractory body is provided with a horn-shaped center opening 28 which communicates with the central zone of cavity 26 in the base section, and a circular array of horn-shaped bores 29 which communicate with the outer zone of cavity 26. The top section TS, as shown in FIGS. 5 and 7, is provided with a horn-shaped center opening 30 which is in registration with center opening 28 of the intermediate section and represents an extension thereof. Also provided on top section TS is a circular array of horn-shaped bores 31 which are in registration with the array of bores 29 in the intermediate section and represent an extension of these bores.

The relationship of burner head 10 to the refractory block is such that the outerwardly-directed, omnidirectional flame $F_l$ projected from the lower portion $C_l$ of the cylindrical array of jet openings impinges on the wall of cavity 26 of base section BS, while the outwardly-direction, omnidirectional flame $F_2$ projected from the upper section $C_u$ of the array impinges on the wall of the center opening 28 of the intermediate section IS.

Flames $F_1$ and $F_2$ impinging on the wall surfaces of the refractory body produce a high-density flux of maximum radiance. The flame itself is not the source of infrared radiation, for its function is to heat the surface of the refractory body to a temperature level (i.e. 1800° to 2200° F.) at which the refractory then emits infrared energy n the micron range to effect the desired heating of the wok subjected to the IR radiation.

As the temperature of the refractory surface is increased, the maximum IR radiation occurs at shorter wavelengths and has a much higher intensity, with an increasingly greater portion of the radiation occurring nearer the visible range in the electromagnetic spectrum. Infrared rays travel in straight line until they strike an absorbing surface; hence radiant heat follows the same physical laws as light waves and travels at the same speed.

As a result of infrared radiation emanating from the wall of the center opening 28 in the intermediate section IS, and IR main beam is produced which is projected through the radiation horn defined by central openings 29 and 31 to impinge on the central region $R_c$ of wok W. And as a result of infrared radiation emanating from the wall of cavity 26 in the base section BS, a multiplicity of secondary IR beams is projected through the radiation horns defined by bores 29 and 31 of the intermediate and top sections which impinge on the annular region $R_a$ surrounding the central region $R_c$ of wok W.

Because the wall of cavity 26 of the base section is more distant from burner head 10 than the wall of opening 28 in the intermediate section, the intensity of the main beam is greater than the intensities of the secondary beams. Hence the level of heat energy applied to the central region of the wok exceeds that applied to the annular region, while the outer region $R_o$ of the wok runs relatively cool.

These conditions are conducive to efficient wok cooking in which the food load is mainly deposited in the central region. It also serves to limit the transfer of heat energy to the stove counter surrounding the IR heater, thereby obviating the need for cooling coils, and it also limits the amount of heat transferred to the atmosphere.

While there has been shown and described a preferred embodiment of an infrared wok heater in accordance with the invention, it will be appreciated that many changes and modifications may be made therein without, however, departing from the essential spirit thereof.

I claim:

1. An infrared heater for a bowl-shaped cooking wok having a central region and an annular region surrounding the central region, the heater comprising:

(a) a ribbon-type, gas-fired burner head to which a pressurized mixture of combustion air and a gaseous fuel is supplied which is expelled from the head through a cylindrical array of minute jet openings to produce, when ignited, an omnidirectional flame projected from a lower portion of the array and from an upper portion thereof;

(b) a block of refractory material which when heated to an elevated temperature by the burner head emits infrared radiation, the block having a base section provided with a circular cavity having a central zone and an outer zone; an intermediate section having a central opening communicating with the central zone of the cavity and a circular array of bores communicating with the outer zone of the cavity, and a top section having a central opening aligned with the central zone of the intermediate section and a circular array of bores aligned with the bores of the intermediate section; said burner head being placed within said block so that the flame projected from the lower portion of the cylindrical array impinges on the wall of the cavity whereby the resultant radiation is emitted through the bores in the intermediate and top sections to provide secondary infrared radiation beams, the flame projected from the upper portion of the cylindrical array impinging on the wall of the opening in the intermediate section whereby the resultant radiation is emitted through the openings in the intermediate and top sections to provide a main beam; and (c) means to seat the wok above the block so that its central region is heated by the main beam and its annular region is heated by the secondary beams.

2. A heater as set forth in claim 1, wherein said block is received in a cylindrical open casing whose upper rim is provided with upwardly projecting studs on which the wok is seated.

3. A heater as set forth in claim 1, wherein said block sections are integrated.

4. A heater as set forth in claim 2, wherein said wok includes a peripheral region which when the wok is seated above the block is outside the block.

5. A heater as set forth in claim 1, wherein said burner is constituted by a stack of corrugated, ring-shaped ribbons which define said cylindrical array.

6. A heater as set forth in claim 1, wherein said stack of ribbons is sandwiched between upper and lower disks to define an internal chamber into which said mixture is fed.

7. A heater as set forth in claim 6, wherein a nipple is attached to the lower disk to feed the mixture into said chamber.

8. A heater as set forth in claim 7, wherein said base section is provided with a center bore communicating with said cavity to receive said nipple.

9. A heater as set forth in claim 1, wherein said openings and bores have the configuration of radiation horns.

10. An infrared radiation heater for a cooking receptacle, the heater comprising:

(a) a gas-fired burner head to which is supplied a mixture of combustion air and a gaseous fuel which is expelled outwardly from the head through jet openings to produce, when ignited, a flame that is projected laterally from the head;

(b) a block of refractory material having a cavity therein in which said head is disposed to define a combustion chamber in which a wall of the cavity surrounds the head whereby said flame produced in said chamber impinges on the wall of the cavity to heat the block to an elevated temperature at which the block emits infrared radiation, said block having an opening therein which extends between the cavity and one end of the block to define a radiation horn from which the radiation is projected; and (c) means to heat said receptacle above the end of the block so that the projected radiation impinges thereon to heat the receptacle.

11. A heater as set forth in claim 10, wherein said receptacle is a wok and said radiation is directed to the central region of the wok.

12. A heater as set forth in claim 10, wherein said burner head is of the ribbon type to define a cylindrical array of minute jet openings to produce when ignited an omnidirectional flame.

* * * * *